United States Patent [19]

Owen

[11] 4,181,466

[45] Jan. 1, 1980

[54] CENTRIFUGAL COMPRESSOR AND COVER

[75] Inventor: Bruce R. Owen, Indianapolis, Ind.

[73] Assignee: Wallace Murray Corp., Indianapolis, Ind.

[21] Appl. No.: 778,372

[22] Filed: Mar. 17, 1977

[51] Int. Cl.[2] ..... F01D 25/24

[52] U.S. Cl. ..... 415/204; 415/207; 415/219 A; 415/219 C; 60/605; 29/156.4 R

[58] Field of Search ..... 415/204, 207, 219 A, 415/219 C; 417/407; 60/605; 29/156.4 R, 156.8 CF

[56] References Cited

U.S. PATENT DOCUMENTS

| | | | |
|---|---|---|---|
| 2,695,131 | 11/1954 | Price | 415/211 X |
| 3,289,921 | 12/1966 | Soo | 415/207 |
| 3,829,235 | 8/1974 | Woollenweber, Jr. | 417/407 |

FOREIGN PATENT DOCUMENTS

| | | | |
|---|---|---|---|
| 846802 | 8/1952 | Fed. Rep. of Germany | 417/407 |
| 907976 | 8/1945 | France | 415/204 |
| 347457 | 9/1972 | U.S.S.R. | 417/407 |
| 486137 | 1/1976 | U.S.S.R. | 417/407 |

*Primary Examiner*—Robert E. Garret

*Attorney, Agent, or Firm*—Woodard, Weikart, Emhardt & Naughton

[57] ABSTRACT

A centrifugal compressor is described herein which comprises a bearing housing, an impeller rotatably mounted to the housing, and an integral compressor cover mounted upon the housing and including an impeller chamber within which the impeller is received. The compressor cover includes a wall portion which defines the impeller chamber and further includes a scroll portion defining a volute passageway surrounding the impeller chamber. The scroll portion includes a mounting flange having a cylindrical pilot surface secured to a mounting flange on the bearing housing. The cover further includes a ring-like flange extending outwardly from one end of the wall portion and forming with the mounting flanges of the scroll and bearing housing an annular, diffuser passageway communicating with the volute passageway and the impeller chamber. The diffuser flange extends radially outward of the pilot surface of the scroll, only the portion of the diffuser flange which is radially inward of the pilot surface being machined. The diffuser flange includes a negative, axial offset at a location radially at or inward of the pilot surface and continuing for the outward extent of the flange.

6 Claims, 2 Drawing Figures

CENTRIFUGAL COMPRESSOR AND COVER

BACKGROUND OF THE INVENTION

1. Field of the Invention

The present invention relates to centrifugal compressors and covers therefor, and more particularly to an integral cover which includes a diffuser flange extending outwardly of the pilot surface on the mounting flange of the scroll.

2. Description of the Prior Art

Centrifugal compressors are used in various applications for pressurizing a fluid and delivering it through an outlet passageway. The centrifugal compressor typically comprises an impeller mounted within a closely-conforming impeller chamber. The chamber has an axial, inlet port or passageway for permitting the fluid to enter the chamber adjacent the center of the impeller. The fluid is drawn into the chamber by rotation of the impeller and is delivered thereby through an annular, diffuser passageway into a surrounding volute, outlet passageway. The rotation of the impeller imparts a velocity to the particles of the fluid. The energy of the fluid represented by this velocity is converted through the medium of the diffuser passageway into a pressure within the scroll or volute passageway.

In many applications, it is desirable that the centrifugal compressor include an integral cover which defines the impeller chamber, diffuser passageway and volute, outlet passageway. Use of a single component generally provides reduced production and material costs. In addition, the unitary construction avoids possible pressure losses which might occur at the seams between separate components and could thereby reduce the efficiency of the compressor. The single element cover is also generally more resistant to external stresses applied to the cover, such as by the vibrations of an engine upon which a supercharger might be installed.

The use of a unitary or integral compressor cover does entail some potential problems, however, particularly since full access is not readily available to the internal surfaces of the scroll and diffuser sections. In particular, it is preferred that the surfaces of the diffuser passageway be machined to provide a minimal resistance to the fluid which will pass therethrough, and machining of certain of the internal surfaces of an integral compressor cover is impractical to a large extent. The present invention provides an integral compressor cover which permits a significant amount of the passageway surfaces to be machined smooth, by conventional methods, and provides a compressor which operates with improved efficiency over prior art compressors having an integral cover.

Integral compressor covers are being produced which are similar to the cover of the present invention. These integral covers include a wall portion defining the impeller chamber and a scroll defining a surrounding, volute passageway communicating with the impeller chamber through an annular, diffuser passageway. One side of the diffuser passageway is formed by a ring-like flange which extends outwardly from the impeller chamber at the end nearest the bearing housing. The other side of the diffuser passageway is defined by a wall portion of the bearing housing which extends generally parallel to the diffuser flange. The compressor cover includes a mounting flange extending from the scroll portion of the cover and having a cylindrical pilot surface which seats against the bearing housing. Prior to the present invention, the diffuser flange of many prior art devices had not been extended beyond the pilot surface of the mounting flange of the scroll because of the increased difficulties in machining the surface of the diffuser flange. Because the pilot surface is cylindrical, the portion of the diffuser flange which is radially inward of the pilot surface is easily machined by conventional methods by insertion of the machining tool through the circular opening and against the diffuser flange. However, it is more difficult and correspondingly more expensive to machine a portion of the diffuser flange which would extend outwardly of the pilot surface.

At the same time, it has been found to be desirable to have the outside radius of the diffuser passageway, and therefore of the diffuser flange in the integral compressor cover, be at least one and one-half times the maximum radial measurement of the impeller, since this results in improved efficiency for the compressor. This has created a problem in connection with the use of integral compressor covers. Bearing housings are of standard size and dimensions, and it is not practical to redesign a bearing housing for each different impeller size and shape which may be used therewith. The portion of the bearing housing forming one wall of the diffuser passageway could therefore not be readily extended. As a result, the pilot surface may not simply be moved outwardly to permit full machining of a more radially-extended diffuser flange. The diffuser flange also could not simply be extended outwardly of the pilot surface since machining of only the portion of the flange which is radially inward of the pilot surface would create a positive offset at the outward extent of the machined portion of the flange. As used herein, the term positive offset is intended to describe an offset which is positive as viewed in a radially-outward direction from the rotational axis of the impeller. In other words, proceeding in the direction away from the impeller axis the axial dimension of the diffuser passageway decreases at the location of a positive offset. Conversely, a negative offset is intended to describe an offset which is negative as viewed in a radially-outward direction, and in proceeding away from the impeller axis the axial dimension of the diffuser passageway increases at the negative offset. Since the diffuser passageway, by definition and in practice, begins at the narrowest, axial width of the annular passageway, the diffuser passageway in the described cover would begin at the location of the positive offset. This would effectively reduce the radial dimension of the diffuser passageway and would reduce the efficiency of the compressor.

The present invention overcomes these problems by providing an integral compressor cover including a diffuser flange which extends outwardly of the pilot surface and may be machined at the portion radially inward of the pilot surface without creating a positive offset. As a result, the cover has the advantages of being integral and including a diffuser passageway which has a maximal radial dimension and outside radius. The cover of the present invention further achieves this maximum radial dimension while also permitting a substantial portion of the diffuser flange to be machined to provide the minimal flow resistance as previously discussed. None of the compressor covers or assemblies of the prior art includes each of these advantages.

In addition to the integral compressor cover of the prior art described above, integral covers are disclosed in U.S. Pat. Nos. 2,465,625, issued to Aue on Mar. 29, 1949; 1,754,724, issued to Mead on Apr. 15, 1930; and, 2,925,952, issued to Garve on Feb. 23, 1960. For none of these covers, however, may a portion of the diffuser flange be readily machined without creating the positive offset as described above.

Most of the integral compressor covers of the prior art include a diffuser flange or comparable component which terminates the diffuser passageway inwardly of the pilot surface. In U.S. Pat. No. 2,695,131, issued to Price on Nov. 23, 1954, there is disclosed an integral compressor cover which includes a diffuser flange which extends outwardly only as far as the pilot surface. A similar compressor cover is disclosed in U.S. Pat. No. 2,777,632, issued to Kishline et al. on Jan. 15, 1957. The Kishline cover further includes a circular disc which is anchored to the wall of the impeller chamber and which extends outwardly into the volute passageway beyond the pilot surface. The circular disc is not integral with the cover, however, and resulting disadvantages include the time and expenses required to produce and install the disc.

An alternate approach has been to move the pilot surface farther outward and to correspondingly extend the portion of the bearing housing which defines one wall of the diffuser passageway. Compressor covers of this type are disclosed in U.S. Pat. Nos. 2,737,897, issued to Dewees on Mar. 13, 1956; 2,285,976, issued to Huitson on June 9, 1942; and, 1,926,225, issued to Birmann on Sept. 12, 1933. The problem with this approach has been previously mentioned and is that the bearing housings are generally of standard dimensions and it is impracticable to modify the bearing housing for each impeller or diffuser passageway configuration to be used therewith.

In U.S. Pat. No. 1,663,998, issued to Schmidt on Mar. 27, 1928, there is disclosed a compressor which includes a diffuser passageway which enters the center, rather than bottom, of the volute passageway. The diffuser passageway is defined by a pair of ring-shaped members spaced a short, axial distance apart. The Schmidt compressor does not employ an integral cover as contemplated by the present invention. The diffuser passageway of the Schmidt device does include negative, axial offsets on both sides of the diffuser passageway, but these are formed by annular flanges which are intended to minimize the pulsations of the fluid as it passes therethrough. These flanges do not relate to enabling the surfaces of the passageway to be machined without creating a positive offset outwardly of the machined portion, as is involved in the present invention.

SUMMARY OF THE INVENTION

One embodiment of the present invention is an integral cover for a centrifugal compressor suitable for use with an internal combustion engine which comprises a wall portion defining an opening generally symmetrical about a central axis, the wall portion having a first end and a second end, a scroll portion adjacent the first end of the wall portion, the scroll portion being integral with the wall portion and connected therewith at a location intermediate the first and second ends, the scroll portion extending from the location and terminating in a cylindrical pilot surface spaced outwardly from the first end of the wall portion, the pilot surface being located a first distance from the central axis, and a diffuser portion integral with the wall portion and connected therewith at the first end, the diffuser portion extending radially outward from the central axis a second distance greater than the first distance, the diffuser portion including a first segment having a surface facing towards but radially inward of the pilot surface and a second segment having a surface facing towards and extending outwardly from a location radially inward of the pilot surface, the surface of the second segment being axially offset from the surface of the first segment in the direction of the second end of the wall portion. A centrifugal compressor comprises the integral cover mounted upon a bearing housing, an impeller is rotatably mounted to the housing and is received within the impeller chamber of the cover, the diffuser portion of the cover together with adjacent portions of the bearing housing and cover form a diffuser passageway communicating with the impeller chamber and volute passageway, the pilot surface seating against a complementary surface of the bearing housing and located radially outward of the impeller.

It is an object of the present invention to provide a centrifugal compressor cover and assembly which is easily produced and results in improved compressor efficiency.

Another object of the present invention is to provide an integral cover for a centrifugal compressor which is suitable for use with standard bearing housings and is adaptable to be used with impellers and diffuser passageways of different configurations and dimensions.

A further object of the present invention is to provide a simple and inexpensive method for producing an integral compressor cover having improved characteristics.

It is another object of the present invention to provide a compressor cover which may be produced by conventional processing and at normal costs but which displays improved performance characteristics.

A further object of the present invention is to provide a compressor cover and assembly which displays the same performance and efficiency levels as less compact units in the prior art.

Further objects and advantages of the present invention will become apparent from the description which follows.

DESCRIPTION OF THE PREFERRED EMBODIMENT

Figure 1:
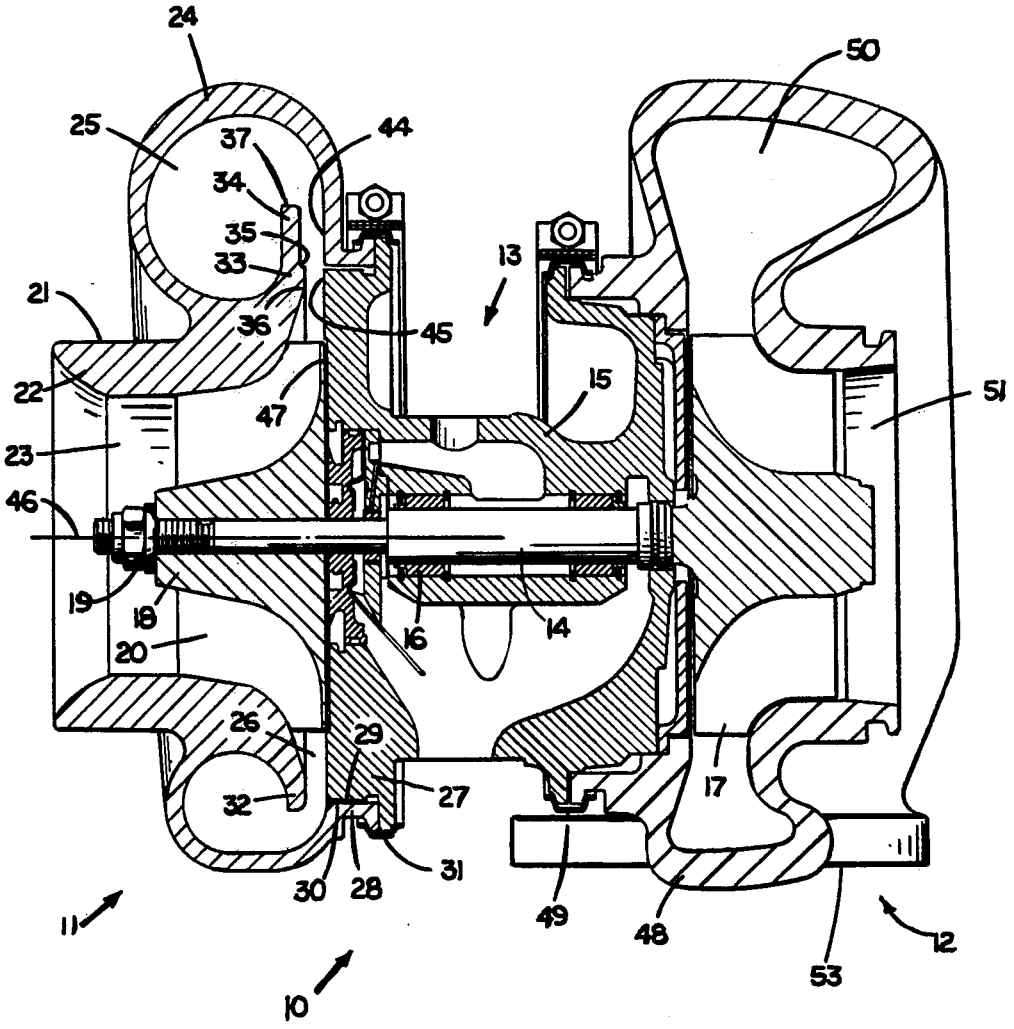
FIG. 1 is a side, cross-sectional view of a turbocharger incorporating the compressor cover and assembly of the present invention.

For the purposes of promoting an understanding of the principles of the invention, reference will now be made to the embodiment illustrated in the drawings and specific language will be used to describe the same. More specifically, the present invention relates to a compressor cover and assembly and will be described with respect to a particular application of a centrifugal compressor as a component of a turbocharger appropriate for use with internal combustion engines. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A centrifugal compressor typically comprises an impeller rotatably mounted within a closely-conforming impeller chamber. The impeller chamber is surrounded by a scroll defining a toroidal or volute passageway communicating with the impeller chamber adjacent the base of the impeller through a diffuser section. The diffuser section is an annular or ring-like passageway having inside and outside radial dimensions for each circumferential station of the impeller chamber and scroll. By definition, the inside radius of the diffuser section corresponds to the distance to the diffuser throat or the location at which the annular port or passageway has the smallest axial width for the given station, the diffuser section extending outwardly for the remainder of the annular passageway.

Referring now to the figures, there is shown a turbocharger assembly 10 including a compressor 11 constructed in accordance with the present invention. The two main subassemblies of turbocharger 10 are the compressor 11 and turbine 12. Bearing housing assembly 13 supports and inter-connects the compressor 11 and the turbine 12.

Assembly 13 includes a shaft 14 rotatably supported within standard bearing housing 15 by sleeve bearings 16. Turbine wheel 17 is connected to one end of shaft 14 and is received within turbine housing 48 secured to bearing housing 15 by V-clamp 49. Impeller 18 includes a central bore within which the other end of shaft 14 is received, impeller 18 being secured to shaft 14 by locknut 19 which is threadedly received upon the end of shaft 14.

Exhaust gas from the exhaust manifold of an engine to which turbocharger 10 is connected enters turbine housing 48 through turbine inlet 53 and thereafter enters volute 50. The gas enters the turbine wheel 17 around its periphery and expands through exhaust outlet 51. Energy of the exhaust gas is thereby converted to mechanical work, turning wheel 17 and driving shaft 14 and compressor wheel or impeller 18. The impeller 18 is used to compress air to increase the amount of air delivered to the engine cylinders above that available in natural aspiration. The compressed air exits compressor 11 through a tangential outlet communicating with passageway 25 and connected to the engine intake manifold or air induction system. As a result, the engine burns more fuel and produces greater power.

Assembly 13 may comprise any suitable combination of bearing, lubricating and sealing elements required to rotatably support shaft 14 in the conditions of operation. The specific components of bearing housing assembly 13 do not constitute a part of the present invention, and therefore will not be recited in detail, these components and their interrelationships being known in the art.

Compressor wheel or impeller 18 is mounted upon shaft 14 and is operable to rotate therewith about axis 46. Impeller 18 includes radial fins or blades 20. Integral compressor cover 21 is attached to bearing housing 15 and includes a wall portion 22 defining an impeller chamber 23 which closely conforms to the profile of blades 20. Cover 21 further comprises a scroll 24 defining a toroidal or volute passageway 25 which surrounds impeller chamber 23 and communicates therewith through annular diffuser passageway 26. Upon rotation of impeller 18, the fluid to be pressurized is drawn inwardly into impeller chamber 23 by blades 20 and is propelled through diffuser passageway 26 into the volute, outlet passageway 25.

Bearing housing 15 includes a mounting flange 27 which extends adjacent and outwardly beyond the back 47 of impeller 18. Compressor cover 21 includes a mounting flange 28 which extends axially from scroll 24 and which includes a cylindrical pilot surface 29. Pilot surface 29 is received adjacent a complementary, cylindrical surface 30 on mounting flange 27. Mounting flanges 27 and 28, and therefore cover 21 and bearing housing 15, are secured together by V-clamp 31.

Integral compressor cover 21 further includes an annular diffuser flange 32 which extends outwardly from the bottom of wall portion 22 and into passageway 25. Diffuser flange 32 is spaced apart from surfaces 45 and 44 of mounting flanges 27 and 28, respectively, and defines therewith the diffuser passageway 26. The present invention is particularly applicable in connection with compressors for which there are standardized bearing housings, since the invention permits the radial extent of the diffuser passageway 26 to be varied in circumstances in which it is undesirable or impractical to modify the mounting flange 27 of the bearing housing.

Diffuser flange 32 extends radially outward beyond the pilot surface 29 of mounting flange 28. Diffuser flange 32 includes a first segment 33 which is radially inward of pilot surface 29, and a second segment 34 which is axially offset from first segment 33 and extends outwardly of pilot surface 29. Second segment 34 extends radially inward as far as annular shoulder 35, which may be located radially at or inward of pilot surface 29. Diffuser passageway 26 therefore extends from location 36, which is the radially innermost location at which the axial width of the passageway is the smallest, outwardly to the end 37 of diffuser flange 32.

As previously indicated, it is desirable that as much as possible of the surfaces defining diffuser passageway 26 be machined to enable precise control of the passageway size and configuration and to provide minimal resistance to the flow of the compressed fluid therebetween. It has also been found that for efficient operation of the compressor, the radial length of the diffuser passageway 26 should be maximized and the radial extent or outside radius of the passageway should terminate at least in part at a location at least one and one-half times the maximum radial dimension of impeller 18. It is also preferable, however, that the time and expense required in machining the surfaces defining the diffuser passageway not be commercially prohibitive. The design of the compressor cover and assembly of the present invention satisfies the aforementioned objectives.

Figure 2:
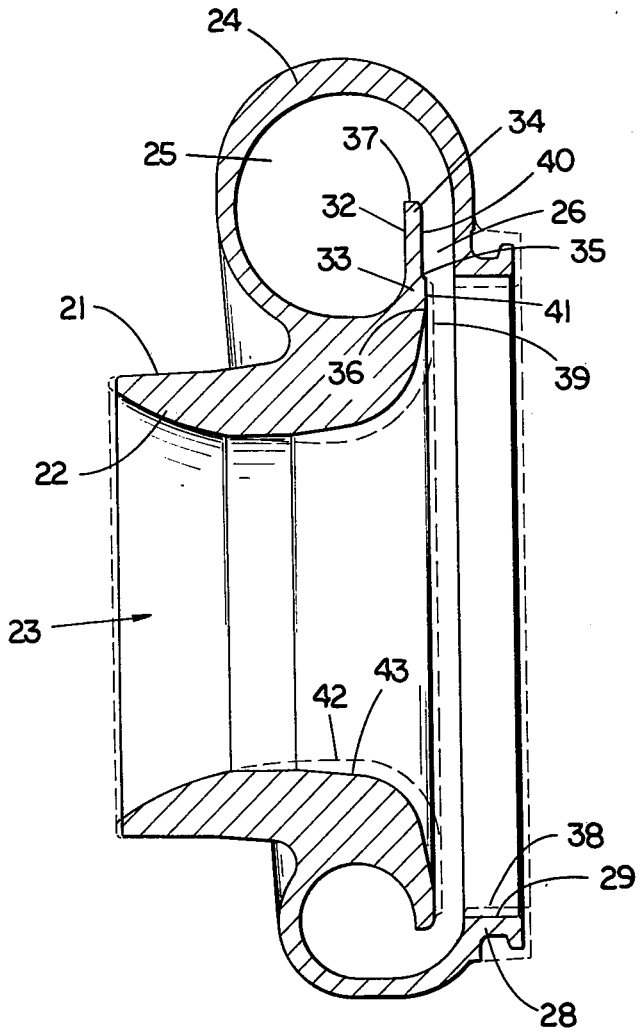
FIG. 2 is a side, cross-sectional view of a compressor cover of the present invention.

Compressor cover 21 is an integral or unitary component which is cast from metal. The form of the cast cover in the preferred embodiment is indicated in FIG. 2 by dashed lines, although the shape of the impeller chamber and volute passageway may be varied as desired for a particular application of the cover. Select portions of the cover are then machines to the desired contours and tolerances as indicated by the solid lines in FIG. 2. In particular, the cast cover 21 includes wall portion 22 defining impeller chamber 23, and further includes scroll 24 defining volute passageway 25. Extending from scroll 24 is the mounting flange 28 which has a cast surface 38 subsequently machined to provide pilot surface 29.

Cover 21 further includes diffuser flange 32 comprising first segment 33 and second segment 34. First segment 33 initially has a cast surface 39 which extends inwardly from annular shoulder 35. Second segment 34 has a cast surface 40 having a negative, axial offset from cast surface 39. To provide a smoother and more controlled configuration of the surface of first segment 33, cast surface 39 is machined by conventional techniques to provide surface 41. Surface 40 of second segment 34 remains negatively offset from machined surface 41 of first segment 33. The diffuser passageway 26 therefore extends the full length from location 36, at which the diffuser passageway 26 is the narrowest radially inward portion, to the end 37 of diffuser flange 32. If surface 40 was positively offset from machined surface 41, then the diffuser passageway would not effectively begin until the location of the positive offset, and this is undesirable as previously explained since the length of the diffuser passageway would be decreased. Providing for first segment 33 to be machined without leaving a positive offset of second segment 34 is one aspect of the present invention. It would be acceptable, and perhaps preferable, to have surface 40 coplanar with machined surface 41, but the normal manufacturing tolerances attendant to casting versus machining make this essentially impossible to obtain. The normal tolerance for a shell core casting is about 0.020 inches in a small span, whereas the normal tolerance obtainable for machined metal is from about 0.003 to about 0.006 inches. Because of the differences in obtainable tolerances of the surfaces, and because it has been found preferable to machine as much of the diffuser flange surface area as possible, the annular shoulder 35 is provided. The machined portion has better tolerance control and better surface finish. The cast surface 39 is machined down to achieve the desired diffuser width. However, it is only machined to the extent to which the avoidance of a positive offset of surface 40 is assured. For the described tolerances, the axial offset is preferably about 0.001 inches, but normal tolerances extend the dimension to about 0.036 inches. The step may be as high as about 0.080 inches or more without the negative step having an appreciable effect on the performance. Control of the dimension of the axial offset enables the first segment 33 to be machined without resulting in a positive offset, and also can be used to change the surging characteristics of the compressor cover and assembly.

The inclusion and particular location of annular shoulder 35 permits the machining of surface 39 of first segment 33 to be accomplished easily and inexpensively by conventional methods, while not resulting in a positive offset at a location outwardly of the machined surface 41. Shoulder 35 is located radially at or inward of the machined pilot surface 29, but may be located radially outward of cast surface 38. In the latter circumstance, as evident in the preferred embodiment of FIG. 2, cast surface 38 is first machined to pilot surface 29 before surface 39 of first segment 33 is machined to provide surface 41.

As is further evident from FIG. 2, in the preferred embodiment the cast, interior surface 42 of wall portion 22 is machined to the desired contour. The interior of wall portion 22 is machined so that the surface 43 more closely conforms to the profile of the impeller received within chamber 23. In addition, the machined surface serves to provide minimal resistance to the flow of the fluid through impeller chamber 23, thus contributing to the efficiency of the compressor.

More generally, the design of compressor cover 31 permits machining of surfaces 42 and 39 to adapt the cover to a variety of compressors in which the profiles of the various impellers may differ, and in which the preferred inside radius or minimal axial width of the diffuser passageway may differ. The present invention therefore has the further advantage of providing a compressor cover and method for making same which permits a cover of a standard, cast configuration to be adapted to a variety of particular compressor assemblies.

The present invention provides a compressor cover and assembly which displays improved operational characteristics over otherwise-comparable devices. The extension of the diffuser flange outwardly of the pilot surface results in the compressor to which the cover is mounted performing at increased efficiencies. A cover and assembly constructed in accordance with the present invention therefore displays greater efficiencies than for similarly-sized devices in the prior art. Similarly, a compressor of a particular efficiency is more compact when constructed in accordance with the present invention than for prior art devices.

The present invention has broad application with respect generally to centrifugal compressors and covers therefor. The diffuser passageway of an integral compressor cover is an annular passageway which has inside and outside radial dimensions for each circumferential station of the impeller chamber and scroll. The inside radius of the diffuser section is the innermost location at which the annular port or passageway has the smallest axial width, the diffuser section extending outwardly for the remainder of the annular passageway. The outside radial dimension may be the same for each station, in which case the diffuser section may be termed symmetrical. Alternatively, the outside radius of the diffuser section or passageway may vary with each station. In the latter instance, the diffuser section or passageway may be termed asymmetrical. The present invention is applicable to centrifugal compressors having either symmetrical or asymmetrical diffuser sections. Vanes may also be included within the diffuser passageway for directing the flow of the compressed fluid from the impeller chamber to the toroidal passageway, and the present invention applies to compressors having both vaned and vaneless diffuser passageways.

As used herein, the term "pilot surface" shall mean the radially innermost portion of the back of the compressor cover whether or not that portion is actually used for indexing.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifugal compressor suitable for use with an internal combustion engine which comprises:

a bearing housing;

an impeller including a back and having a central axis, said impeller having a maximum radial dimension;

means for rotatably mounting said impeller to said bearing housing, said bearing housing including a mounting portion extending adjacent the back of said impeller and radially outward beyond said impeller; and an integral compressor cover having a wall portion defining an impeller chamber and a scroll defining a generally toroidal outlet passageway surrounding the impeller chamber, the wall portion including an internal surface surrounding a portion of said impeller and being machined to conform to the surrounded portion of said impeller, said cover having a mount portion including a pilot surface adjacent and connected to the mounting portion of said bearing housing, said cover further having a diffuser portion spaced apart from the mount portion of said cover and from the mounting portion of the bearing housing, the diffuser portion together with the mount portion of the cover and the mounting portion of the bearing housing defining an annular, diffuser passageway in communication with the outlet passageway, the diffuser portion extending radially from the central axis of said impeller and extending both inward and outward of the pilot surface and at least a part of the diffuser portion having a maximum radial extent from the central axis at least as great as one and one-half times the maximum radial dimension of said impeller, the diffuser portion includng a machined surface only radially inward from the pilot surface, the diffuser passageway decreasing in axial width only in the direction of the central axis of said impeller.

2. The compressor of claim 1 in which the diffuser portion comprises an annular flange extending outwardly from the wall portion of said cover.

3. The compressor of claim 1 in which the diffuser portion of said cover includes a negative, axial offset for its radially outward extent from a location at least as radially inward as the pilot surface of said mount portion of the scroll, whereby the axial width of the diffuser passageway is expanded immediately outward of the offset.

4. The compressor of claim 3 in which the diffuser portion comprises an annular flange extending outwardly from the wall portion of said cover.

5. The compressor of claim 4 in which the diffuser passageway extends in a plane normal to the central axis of said impeller.

6. The compressor of claim 4 in which the diffuser portion extends into the outlet passageway defined by the scroll.

* * * * *